US005271451A

United States Patent [19]

Chandley et al.

[11] Patent Number: 5,271,451

[45] Date of Patent: Dec. 21, 1993

[54] METAL CASTING USING A MOLD HAVING ATTACHED RISERS

[75] Inventors: George D. Chandley, Amherst; John A. Redemske, Greenfield, both of N.H.

[73] Assignee: General Motors Corporation, Detroit, Mich.

[21] Appl. No.: 938,753

[22] Filed: Sep. 1, 1992

[51] Int. Cl.[5] ..... B22C 9/02; B22C 9/08; B22D 18/06

[52] U.S. Cl. ..... 164/63; 164/122; 164/255; 164/359; 164/360; 164/361; 164/363

[58] Field of Search ..... 164/63, 255, 359, 360, 164/34, 35, 36, 119, 122, 361, 363

[56] References Cited

U.S. PATENT DOCUMENTS

| | | | |
|---|---|---|---|
| 2,476,296 | 7/1949 | Hardy | 164/360 X |
| 4,085,790 | 4/1978 | Wittmoser . | |
| 4,140,838 | 2/1979 | Reiland | 164/360 X |
| 4,340,108 | 7/1982 | Chandley et al. . | |
| 4,616,689 | 10/1986 | Denis . | |
| 4,733,714 | 3/1988 | Smith . | |
| 4,787,434 | 11/1988 | Cleary et al. . | |
| 4,848,439 | 7/1989 | Plant . | |
| 4,874,029 | 10/1989 | Chandley . | |
| 4,957,153 | 9/1990 | Chandley . | |
| 4,971,131 | 11/1990 | Aubin et al. . | |
| 5,042,561 | 8/1991 | Chandley . | |
| 5,062,467 | 11/1991 | Kubisch et al. . | |

FOREIGN PATENT DOCUMENTS

| | | | |
|---|---|---|---|
| 2926906 | 1/1981 | Fed. Rep. of Germany | 164/360 |
| 3113229 | 10/1982 | Fed. Rep. of Germany | 164/360 |
| 3317631 | 11/1984 | Fed. Rep. of Germany | 164/359 |
| 58-116974 | 7/1983 | Japan | 164/34 |
| 61-20645 | 1/1986 | Japan | 164/360 |

*Primary Examiner*—J. Reed Batten, Jr.
*Attorney, Agent, or Firm*—Flynn, Thiel, Boutell & Tanis

[57] ABSTRACT

Apparatus and method for countergravity casting a melt employs a particulate mass disposed in a container about a mold having a mold cavity, an ingate passage communicated to the mold cavity for supplying the melt to the mold cavity, and a separate, preformed riser-forming member connected to the mold so as to communicate to an isolated and/or enlarged region of the mold cavity needing additional melt supply during solidification in the mold. The mold ingate passage and a source of the melt are communicated to conduct the melt through the ingate passage to the mold cavity to fill the mold cavity with the melt and form a riser of melt in the particulate mass. The riser of melt provides a source of additional melt for supply, as necessary, to the isolated and/or enlarged region during solidification of the melt in the mold cavity to accommodate melt shrinkage thereat.

32 Claims, 3 Drawing Sheets

METAL CASTING USING A MOLD HAVING ATTACHED RISERS

FIELD OF THE INVENTION

The present invention relates to the casting of a melt into a mold disposed in a particulate mass and, more particularly, to a mold having separate, preformed riser-forming means connected to the mold at one or more isolated and/or enlarged mold cavity regions in a manner to be disposed in the particulate mass and to communicate to the regions for supplying melt thereto, as necessary, during solidification of the melt to accommodate melt shrinkage.

BACKGROUND OF THE INVENTION

A vacuum-assisted countergravity casting process using a gas permeable, self-supporting mold sealingly received in a vacuum chamber is described in such patents as the Chandley et al. U.S. Pat. Nos. 4,340,108 and 4,606,396. That countergravity casting process involves providing a mold having a porous, gas permeable upper mold member (cope) and a lower mold member (drag) sealingly engaged together at a parting line, sealing the mouth of a vacuum housing to a surface of the mold such that a vacuum chamber formed in the housing confronts the gas permeable cope, immersing the bottom side of the drag in an underlying pool of melt, and evacuating the vacuum chamber to draw the melt upwardly through one or more ingate passages in the drag into one or more mold cavities formed between the cope and the drag.

Recent improvements in the vacuum-assisted countergravity casting process, represented by the Chandley U.S. Pat. No. 4,957,153; the Aubin et al. U.S. Pat. No. 4,971,131; and the Kubisch et al. U.S. Pat. No. 5,062,467 of common assignee herewith, have achieved substantial increases in the production and economies of the process. In these improved casting processes, one or more gas permeable molds, each typically comprising a pair of mated, relatively thin mold halves, are surrounded in a mass of particulate mold material (e.g., binderless foundry sand) held within the open bottom container by establishment of a suitable negative differential pressure between the inside and outside thereof. The particulate mass and the molds are held in the container such that lower melt ingate passages of the molds are exposed at the open bottom end of the container for immersion in an underlying melt pool. The negative differential pressure between the inside and the outside of the container is effective to draw the melt upwardly into the mold cavities formed by the molds in the particulate mass. After the melt has solidified in the molds and the container is moved to an unload station, the negative differential pressure is released to permit gravity-assisted discharge of the particulate mass, castings, and molds through the open bottom end of the container.

While the aforementioned improved countergravity casting processes are preferably practiced using unbonded (i.e., binderless) particulates held within the container by the negative differential pressure, the processes may also be practiced using weakly bonded particulates in a manner taught in the Plant U.S. Pat. No. 4,848,439 wherein the particulates are bonded in-situ in the container by passing a gas/vapor curing agent through binder-coated particulates after they are introduced in the container about the mold(s).

The aforementioned improved countergravity casting processes have exhibited capability to make thin walled castings of air melted alloys and also of vacuum melted alloys as described, for example, in U.S. Pat. No. 5,042,561.

These countergravity casting processes provided a major cost reduction in the production of many casting shapes as a result of reduced use of resin-bonded foundry sand needed for the molds and an increase in the number of castings made per casting cycle. However, in the production of more complex shaped castings having enlarged mold cavity regions isolated from the mold ingate passage entrances from high shrinkage alloys (such as stainless steels), higher cost per casting was experienced as a result of the need for an increased number of ingate passages and/or risers in the resin-bonded molds to supply adequate melt to the isolated, enlarged mold cavity regions. The increased number of ingate passages and/or risers resulted in additional resin-bonded mold sand usage, additional metal (melt) usage, and reduction in the number of castings made per casting cycle as a result of less available space in the vacuum housing, increasing the cost of making castings.

The additional risers needed were molded into the mold halves using appropriate resin-bonded cores. However, such cores can be used to form the riser in the mold only if the riser location is convenient to the mold parting line. Even then, the shape, size, and orientation of the riser are oftentimes restricted by molding process limitations.

It is an object of the invention to provide an improved casting apparatus and process of the type using a particulate mass disposed about one or more molds wherein the need for additional mold ingate passages and/or risers (and resultant additional usage of costly resin-bonded sand) to supply melt, especially of high shrinkage alloys, to isolated and/or enlarged mold cavity regions is eliminated by connecting a preformed riser-forming member to the mold so as to be disposed in the particulate mass and to communicate to a mold region needing supply of additional melt thereto, as necessary, during solidification of the melt in the mold to accommodate melt shrinkage.

It is another object of the invention to provide an improved casting apparatus and process of the type using a particulate mass disposed about one or more molds wherein a destructible, preformed riser-forming member is connected to the mold at one or more isolated and/or enlarged mold cavity regions and is destroyed and replaced by the melt during casting to form a riser of melt in the particulate mass for supplying additional melt to the regions, as necessary, during solidification to accommodate melt shrinkage.

It is still another object of the invention to provide an improved casting apparatus and process of the type using a particulate mass disposed about one or more molds wherein a destructible, preformed organic riser-forming member is connected to the mold at one or more isolated and/or enlarged mold cavity regions and is destroyed in a manner to selectively introduce carbon and/or supplemental heat to the melt forming the riser so as to increase its fluidity for better supply to the regions, as necessary, during solidification to accommodate melt shrinkage.

SUMMARY OF THE INVENTION

The present invention involves improved apparatus and method for casting a melt wherein a particulate mass is disposed about a mold having a mold cavity and an ingate passage communicated to the mold cavity for supplying the melt thereto. A preformed (preformed apart from the mold) riser-forming member is connected to the mold so as to be disposed in the particulate mass and to communicate to a region of the mold cavity needing additional melt supply during solidification in the mold as a result of the region's being enlarged and/or remote from the ingate passage entrance. The mold ingate passage and a source of the melt are communicated to supply the melt through the ingate passage to the mold cavity to fill the mold cavity with the melt and form a riser of melt disposed in the particulate mass. The riser of melt supplies additional melt, as necessary, to the remote and/or enlarged mold cavity region during solidification of the melt therein to accommodate melt shrinkage; i.e., to prevent melt shrinkage defects in the solidified casting.

In one embodiment of the invention, the riser-forming member comprises a destructible material that is destroyed and replaced in the particulate mass by the melt supplied to the mold and riser-forming member. In casting metals with large volumetric shrinkage, such as steels, the destructible riser-forming member comprises an organic material that selectively introduces carbon to the melt forming the riser. The carbon increases the fluidity of the melt to aid in supply thereof to the remote and/or enlarged mold cavity region during solidification. Alternately or in addition, the riser-forming member can include an outer shell or sleeve comprising an insulating and/or exothermic material that, in effect, provides a relatively higher temperature riser of melt so as to increase melt fluidity to this same end.

In another embodiment of the invention, the riser-forming member is connected to the mold at a passage therein communicating to the remote and/or enlarged mold cavity region. The riser-forming member includes a protrusion that is received in the passage. The riser-forming member can be glued to the mold at the particular remote and/or enlarged mold cavity region.

The present invention also contemplates a mold for casting a melt wherein the mold comprises a mold cavity and an ingate passage communicated to the mold cavity for supplying melt thereto. A preformed, riser-forming member is connected to the mold so as to communicate to a remote and/or enlarged region of the mold cavity needing additional supply of melt during solidification in the mold to accommodate melt shrinkage. The riser-forming member comprises a heat destructible plastic or other material in one embodiment of the invention. The mold of the invention is especially useful in the countergravity casting of relatively high shrinkage melts, such as stainless steel melts, to accommodate (e.g to reduce, preferably eliminate) melt shrinkage at one or more remote and/or enlarged mold cavity regions to prevent shrinkage defects in the solidified casting.

DESCRIPTION OF THE DRAWINGS

The objects and advantages of the present invention enumerated above will become more readily apparent from the following detailed description and drawings where.

DETAILED DESCRIPTION OF THE INVENTION

Figure 1:
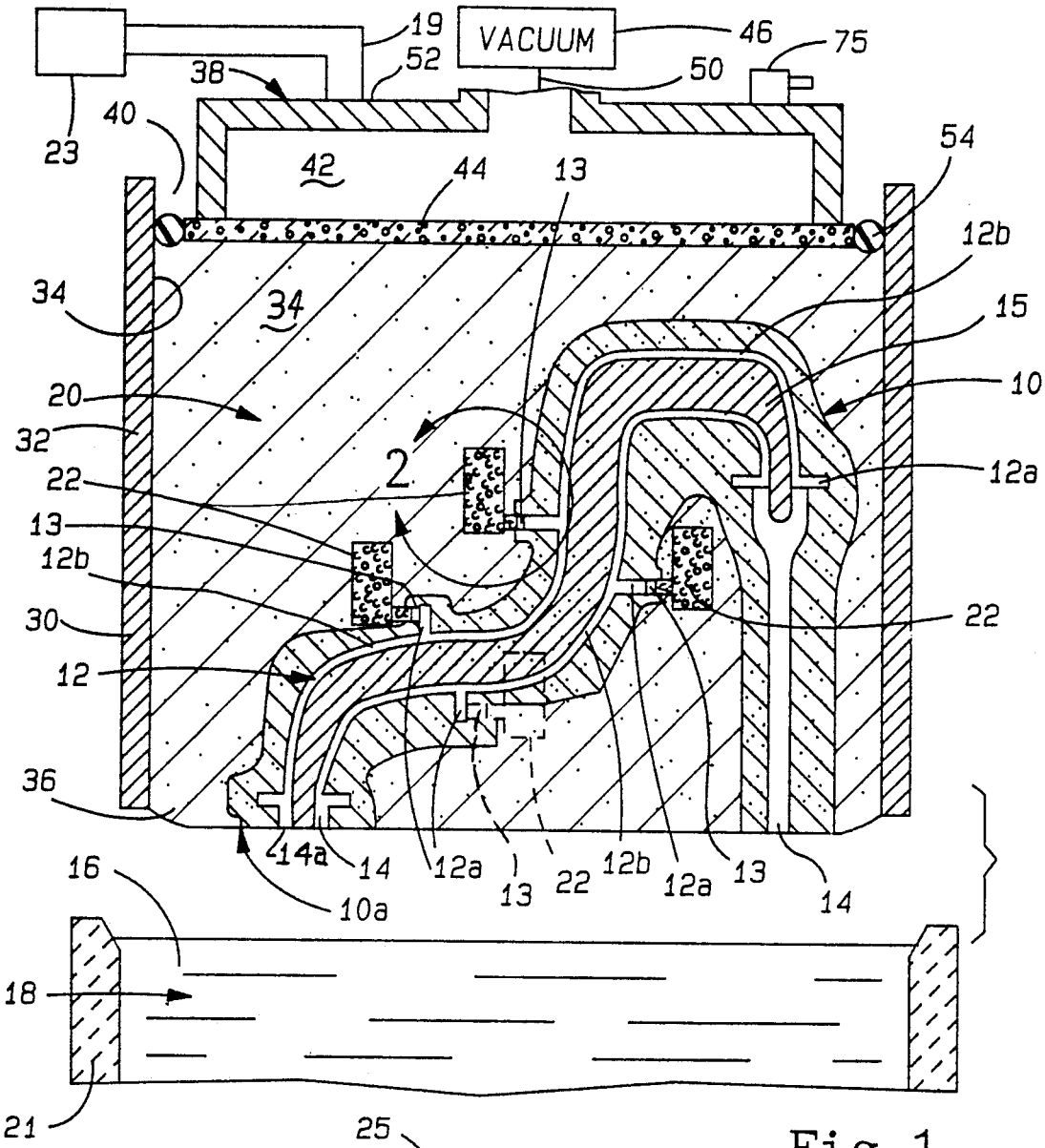
FIG. 1 is a side sectioned view of a countergravity casting apparatus in accordance with one embodiment of the invention.
Figure 2:
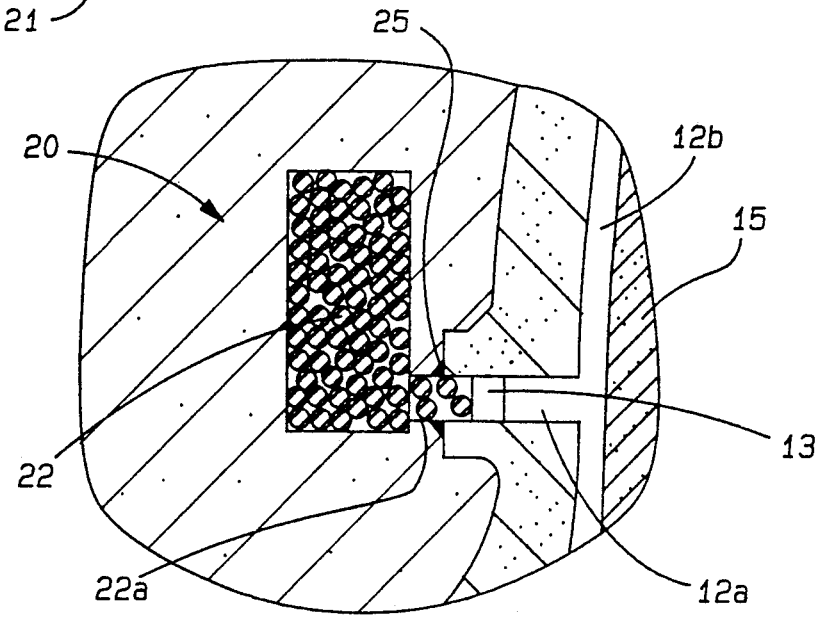
FIG. 2 is an enlarged sectional view of the encircle region designated "2" in FIG. 1 illustrating the connection of a riser-forming member to the mold.
Figure 3:
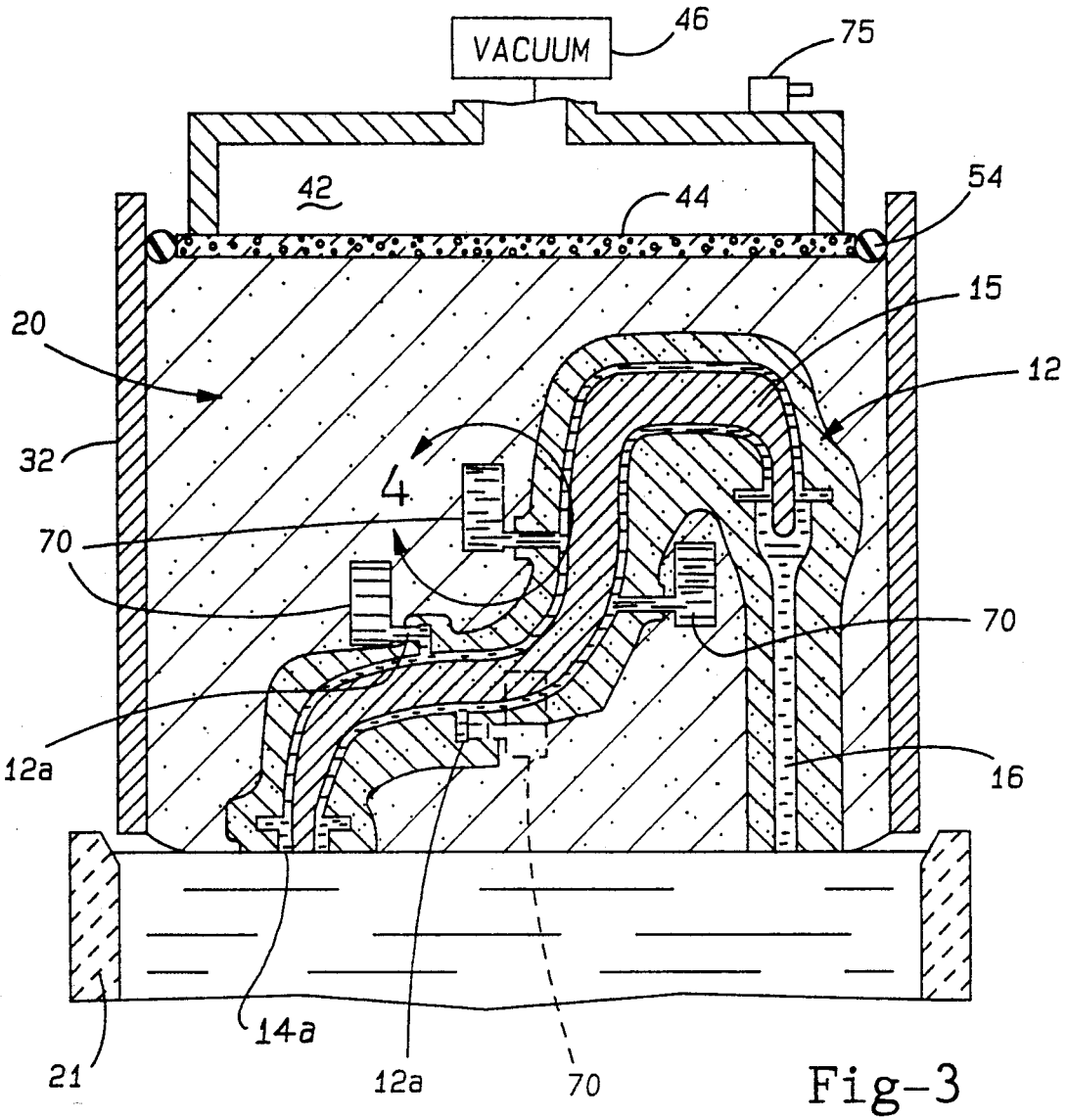
FIG. 3 is a side sectioned view similar to FIG. 1 after molten metal is drawn into the mold.

For purposes of illustration only, FIGS. 1-3 depict one embodiment of an apparatus of the present invention for the vacuum-assisted, countergravity casting of a melt into one or more (one shown) gas permeable molds 10 disposed in a particulate mass 20 held in an open bottom container 30 by a negative differential pressure established between the inside and the outside of the container 30 in accordance with U.S. Pat. No. 4,957,153, the teachings of which are incorporated herein by reference. The present invention is especially useful, although not limited to, the countergravity casting of high shrinkage metal or alloy melts. By high shrinkage is meant a metal or alloy that exhibits a shrinkage of about 3 volume % or more solidification. Exemplary of a high shrinkage metal or alloy to which the invention is especially useful are the family of stainless steels including austenitic stainless steels such as AISI 304 and ferritic stainless steels such as AISI 410 and 430.

Moreover, the present invention is especially useful in making complex shaped castings of such high shrinkage metals or alloys. A particular exemplary complex shape is illustrated in FIG. 1 as a mold cavity 12 having the configuration of an internal combustion engine exhaust or intake manifold. The illustrated mold cavity 12 includes relatively thick cross-section manifold regions 12*a* (e.g. forming manifold flanges, bosses, pads, and the like) and relatively thin cross-section manifold wall regions 12*b*. The regions 12*a* are thus enlarged relative to the wall regions 12*b*. Moreover, some of the regions 12*a* are isolated or remote from the associated ingate passage 14.

The mold 10 includes a plurality of the ingate passages (melt inlet passages) 14 communicated at their upper ends to the mold cavity 12 and at their lower ends to a lower mold bottom or underside 10*a*. The ingate passages 14 are adapted to supply the melt 16 from a melt source, such as melt pool 18 contained in an underlying crucible 21, to the mold cavity 12 when a suitable negative differential pressure is established between the mold cavity 12 and the melt pool 18 when the mold underside 10*a* and pool 18 are engaged (e.g., when underside 10*a* is immersed in the pool 18).

The mold 10 also is illustrated in the embodiment of FIGS. 1-3 as including one or more preformed, destructible riser-forming members 22 connected to the mold 10 at appropriate locations to communicate to the enlarged manifold regions 12*a* which are disposed remote from the ingate entrances 14*a*. As a result, the thicker regions 12*a* typically need additional melt supply during solidification in the mold to accommodate melt shrinkage at the regions 12*a*; i.e., to preferably eliminate melt shrinkage defects, such shrinkage porosity, therein. The riser-forming members 22 are preformed in that they are made apart from the mold 10 as separate components and then connected to the mold 10 in a manner described hereinbelow.

The riser-forming members 22 preferably each comprise a destructible material that is destroyed and replaced by the melt 16 in the particulate mass 20 in the container 30. For example, in countergravity casting stainless steels, the preformed riser-forming members 22 preferably comprise expanded polystyrene foam plastic material that is vaporized by the melt 16 drawn to the riser-forming members 22 during countergravity casting. The melt 16 replaces the riser-forming members 22 in the particulate mass 20 (i.e. the risers of melt are bounded or surrounded by the mass 20) to provide blind risers 70 of melt 16 in the mass 20 as shown best in FIG. 3. Other foamable, moldable hydrocarbons such as poly-methacrylate are useful for the destructible riser-forming members 22. Riser-forming members 22 made of expanded polystyrene foam and similar materials typically are molded to the desired riser shape using conventional molding techniques.

When a stainless steel melt 16 is countergravity cast into the mold 10, the plastic (organic) riser-forming members 22 have been found to selectively introduce enough carbon to the melt that replaces the riser-forming members 22 in the particulate mass 20 to enhance melt fluidity and aid in feeding of the regions 12*a* with additional melt, as needed, during solidification in the mold. For example, the carbon content of the melt (e.g., AISI 410 stainless steel) replacing the riser-forming members 22 in the particulate mass 20 has been observed to increase by about 0.3 weight % when the riser-forming members comprise expanded polystyrene foam having a density of 1.75 pounds/cubic foot. The increase in carbon content of the melt replacing the riser-forming members 22 lowers the melting point of the stainless steel and improves feeding of the melt to the regions 12*a* of the mold cavity 12, as necessary, during solidification into the mold. The riser-forming members 22 can be designed to have a height so as to confine the higher carbon melt predominantly to the upper region of the blind riser 70 formed in the particulate mass 20 so as to minimize contamination of the casting.

Figure 4:
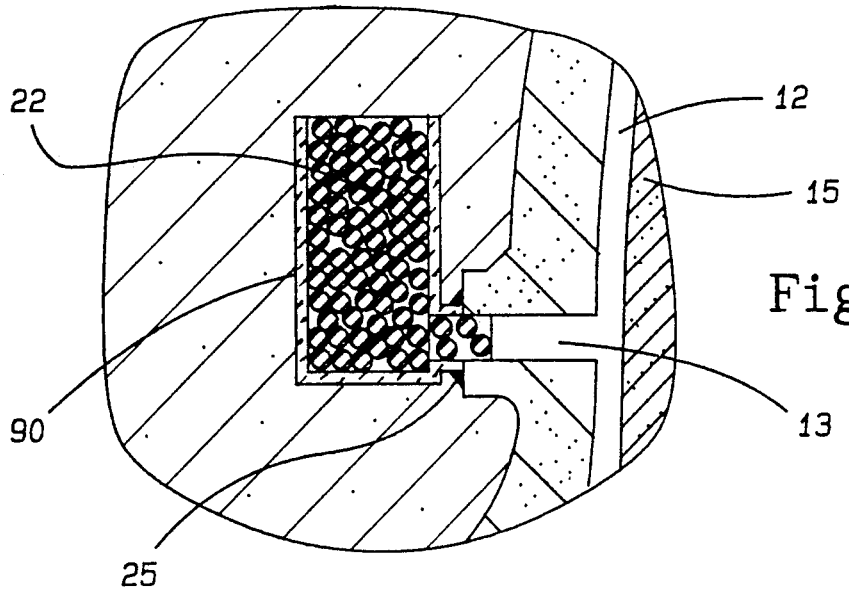
FIG. 4 is an enlarged sectioned view of a riser-forming member (i.e., a riser sleeve) in accordance with another embodiment of the invention.

The riser-forming members 22 each may have an outer insulating (e.g. alumina refractory fiber) shell or sleeve 90, FIG. 4, disposed thereabout to insulate the melt that replaces the destructible riser-forming member 22 in the particulate mass 20 so as to provide a relatively higher temperature riser of melt having enhanced fluidity for filling the associated mold region during melt solidification. The outer sleeve 90 may be made of an exothermic material, such as FEEDEX 724 material available from Foseco, Conneaut, Ohio, to introduce or release heat to the melt as it replaces the riser-forming member 22 in the particulate mass 20, thereby also providing a relatively higher temperature riser of melt for improved fluidity purposes during solidification. The sleeve 90 can be made of insulating and/or exothermic material to this end.

Figure 5:
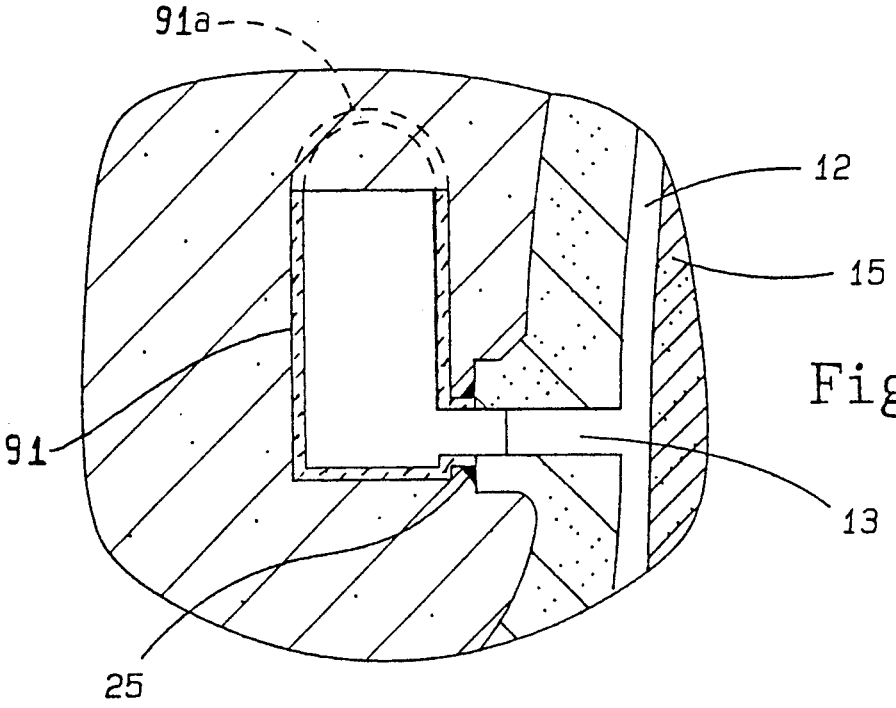
FIG. 5 is an enlarged sectioned view of a riser-forming member in accordance with still another embodiment of the invention.

In an alternate embodiment of the invention, the destructible plastic riser-forming members 22 may be replaced by preformed riser sleeves 91 as shown in FIG. 5 where like features are represented by like reference numerals. The sleeves 91 communicate to the enlarged regions 12*a* and are filled with the melt drawn into the mold 10 so as to supply additional melt to the regions 12*a*, as necessary, during solidification in the mold. The sleeves 91 can be made of a commercial exothermic material such as EXOMOLD LD3 material supplied by Foseco, Conneaut, Ohio and connected to the mold by hot melt glue. The sleeves 91 optionally may be closed at the upper end by an upper wall 91*a* (see phantom lines in FIG. 5). In this event, the destructible polystyrene foam can be omitted from inside each sleeve 91.

The size, shape and orientation of the riser-forming members 22 relative to the mold 10 can be selected to provide additional melt 16 to the regions 12*a*, as necessary, during solidification of the melt in the mold to produce a casting without melt shrinkage defects at the regions 12*a*. Suitable sizes, shapes, and orientations of the riser-forming members 22 can be determined empirically from casting trials. Cylindrical riser-forming members 22 having a size of 1½ inches diameter by 3 inches in height have been used in practicing the invention to vacuum countergravity cast a AISI 410 stainless steel into the mold 10 to form an exhaust manifold. Preferably, the riser-forming members 22 are oriented as shown in FIGS. 1-3 to provide gravity-assisted feeding of the additional melt to the regions 12*a* during solidification. Since the location of the riser-forming members 22 is not restricted to the parting line of the mold 10, the riser-forming members 22 can be located and oriented without use of expensive bonded sand cores as needed in the prior art to produce an acceptable casting without shrinkage defects at the regions 12*a*.

As shown in FIG. 2, the riser-forming members 22 each include a protrusion 22*a* extending into a passage 13 formed in the gas permeable mold 10. As is apparent, the passage 13 communicates to and extends from the region 12*a* of the mold cavity 12. Each riser-forming member 22 is thereby communicated to the associated region 12*a* of the mold cavity 12 when the melt 16 is drawn into the mold cavity 12 and destroys and replaces the riser-forming member 22 in the particulate mass 20. The protrusions 22*a* typically are connected to the mold 10 by glue (e.g., hot melt glue) or other adhesive 25 applied between the periphery of the protrusion 22*a* and the proximate mold exterior surface as shown best in FIG. 2. The riser-forming members 22 are attached to the mold 10 prior to surrounding the mold in the particulate mass 20. The riser-forming members 22 also can be attached to the mold 10 by mechanical techniques such as force fitting the protrusions 22*a* into the respective passages 13.

The mold 10 is typically formed from thin, self-supporting, resin-bonded mold halves that are joined (e.g., by adhesive) at a vertical (or horizontal) mold parting line with or without a suitable resin-bonded core 15 disposed therebetween. The mold cavity 12, ingates 14, etc. are formed between the joined mold halves. The mold halves can be made using a silica sand (or other refractory particulates)/resin binder mixture shaped and cured (or hardened) on suitable pattern plates for each mold half in accordance with aforementioned U.S. Pat. No. 4,957,153. The binder may comprise inorganic or organic thermal or chemical setting plastic resin or equivalent bonding material. The binder is usually present in a minor proportion of the mixture, such as about 5% by weight or less of the mixture. Alternately, the mold halves can be made in accordance with copending application Ser. No. 07/797,550, now abandoned, of common as herewith where a silica sand (or other refractory particulates)/resin binder mixture is cured in-situ while the mixture is compacted against a suitable pattern by a pressurized diaphragm. The passages 13 are formed on the mold halves by molding them in-situ thereon, or using appropriate passage-forming tubular members or other means, depending on their orientation to the mold parting line, so that their location is not restricted to the mold parting line.

The optional resin-bonded core 15 can be formed from a similar mixture of silica sand (or other refractory particulates)/resin binder mixture by blowing the mixture into a core box as described in aforementioned U.S. Pat. No. 4,957,153 or as described in aforementioned copending application Ser. No. 07/797,550.

The container 30 includes a peripheral wall 32 defining a vacuum chamber 34 having an open bottom end 36. The container 30 has a vacuum head or bell 38 received sealingly in the open upper end 40 thereof. The vacuum head 38 defines a vacuum chamber 42 that is communicated to the chamber 34 by a gas permeable, particulate impermeable wall 44, such as an apertured screen or a porous ceramic or metallic plate. The vacuum chamber 42 is also communicated to a source of vacuum 46 (e.g., a vacuum pump) by a conduit 50 sealingly fastened on an upper gas impermeable wall 52 so that a negative differential pressure can be established between the inside and outside of the container 30 as desired during the casting process. The vacuum head 38 includes one or more peripheral seals 54 (one shown) for sealingly engaging the peripheral wall 32 when the vacuum head is assembled within the container 30.

The particulate mass 20 is disposed in the container 30 about the mold 10 as shown in FIGS. 1-3. Preferably, the particulate mass 20 comprises an inherently unstable particulate mass, such as loose, substantially binderless particulates (e.g., dry foundry sand), although weakly bonded particulates can be used as described in U.S. Pat. No. 4,957,153. Alternately, a first inherently unstable particulate mass supported on a second, lower bonded particulate mass can be used as described in U.S. Pat. No. 5,062,467, the teachings of which are incorporated herein by reference.

In practicing the present invention, the mold 10 is first assembled from the mold halves and core. The riser-forming members 22 are then glued or otherwise connected to the mold 10 at the passages 13. The container 30 (sans the vacuum bell 38) and the assembled mold 10 are then placed on a form plate (not shown) with the mold inside the container. The form plate is configured to shape the bottom of the particulate mass 20 as shown in FIGS. 1-3. A thin aluminum foil sheet (not shown) may be placed on the form plate to enclose the bottom of the particulate mass 20 as described in U.S. Pat. No. 4,957,153. Loose, dry foundry sand is introduced into the container 30 about the mold 10 through the open upper end of the container to form the particulate mass 20 about the mold. Since the riser-forming members 22 are glued to the mold 10, the sand can be added to the container 30 without dislodging the riser-forming members 22. The vacuum head 38 is then sealingly positioned in the container 30 on the particulate mass 20 as shown with the gas permeable, particulate impermeable wall 44 engaging the mass 20. The vacuum chamber 42 of the vacuum bell 38 is then evacuated to establish the desired negative differential pressure between the inside (chamber 34) and outside of the container 30 to hold the mold 10 and particulate mass 20 in the container 30 as it is raised above the form plate and moved to a casting position above the melt pool 18, FIG. 1. The vacuum is also sufficient to hold the additional weight of the castings formed in the mold 10. For example, a vacuum level of 10 inches of mercury has been used to hold a mold 10 weighing 17 pounds, mass 20 weighing 250 pounds, and casting weighing 4.8 pounds in the container 30 having a size of 18 inch inner diameter and height of 26 inches. If the aluminum foil sheet is present on the form plate, it will be held against the bottom of the particulate mass 20 and mold 10 by the negative differential pressure established. The foil sheet is melted away at the time of immersion as the foil contacts the melt so as to expose the ingate passages 14 to the melt 16.

At the casting position, the container 30 with the mold 10 and particulate mass 20 therein is located above the pool 18 of melt 16 as shown in FIG. 1. Typically, an arm 19 attached to the vacuum head 38 is connected to a suitable actuator 23 to effect such movement; as shown, for example, in U.S. Pat. No. 4,874,029, the teachings of which are incorporated herein by reference. The container 30 is then lowered toward the pool 18 to immerse the underside **10*a* of the mold 10 in the melt 16. The relative vacuum established in the chamber 42 is selected sufficient to draw the melt upwardly through the ingate passages 14 into the mold cavity 12 to fill same with the melt. The melt 16 is also drawn to the riser-forming members 22 where the melt vaporizes the riser-forming members and replaces them in the particulate mass 20 as a column of melt constituting a blind riser 70, see FIG. 3. The container 30 and melt-filled mold 10 and mass 20 therein are raised above the pool 18 after the melt in the ingate passages 14 solidifies, or alternately while the melt is still molten and is held in the mold by means such as differential pressure effects and/or melt-holding passages described, for example, in U.S. Pat. No. 4,982,777 and copending U.S. application entitled "Countergravity Casting Apparatus And Method" Ser. No. 07/916,014. The blind risers 70 supply additional melt 16 to the enlarged regions 12*a* to accommodate melt shrinkage as the melt solidifies in the mold 10, thereby producing a casting without shrinkage defects at the regions 12*a*. As mentioned hereinabove, the risers 70 are preferably oriented to provide gravity-assisted filling of the regions 12*a* during melt solidification in the mold while the vacuum is maintained in chamber 42 and after vacuum is released as well. Typically, the container 30 is separated from the vacuum bell 38** before the melt is fully solidified in the mold; i.e., the casting is still partly liquid.

As mentioned hereinabove, when a steel melt 16 is countergravity cast into the mold 10, the plastic (organic) riser-forming members 22, as they are destroyed, selectively introduce enough carbon to the melt that replaces the riser-forming members 22 in the particulate mass 20 to enhance its fluidity and aid in feeding of the regions **12*a* with additional melt, as needed, during solidification in the mold. For example, the carbon content of the melt (e.g., AISI 410 stainless steel) replacing the riser-forming members 22 in the particulate mass 20 has been observed to increase by about 0.3 weight % when the riser-forming members comprise expanded polystyrene foam having a density of 1.75 pounds/cubic feet. The increase in carbon content of the melt replacing the riser-forming members 22 lowers the melting point of the stainless steel and improves feeding of the melt to the regions 12*a* of the mold cavity 12**, as necessary, during solidification in the mold.

At an appropriate time after mold filling, the container 30 is positioned above or on a discharge table or grate (not shown), and the vacuum in the chamber 42 is discontinued to provide ambient pressure in the container 30. A valve 75 may be opened to communicate the chamber 42 to ambient pressure to this end. If the container 30 is positioned above a table or grate, the mold 10 having the casting therein and the particulate mass 20 will fall by gravity out of the container 30 when such ambient pressure is provided so as to discharge the contents to the underlying table or grate. Alternately, the container 30 may be placed on a table and released from the mold 10 by discontinuing the relative vacuum in chamber 42.

The present invention is advantageous in producing complex shape castings from relatively high shrinkage metals or alloys, such as the stainless steels described above, without shrinkage defects at isolated and/or enlarged regions of the mold cavity.

Moreover, the present invention is advantageous in reducing the amount of expensive bonded sand and metal gating weight heretofore required to produce such castings. The present invention reduces the space required in the container 30 for the mold 10 and thus smaller containers can be used. Simpler mold tooling can also be used in fabrication of the mold 10 of the invention. Moreover, greater freedom in locating the riser-forming members 22 on the mold 10, as well as using appropriate riser configurations, is possible since they do not have to be located on the mold parting line. Although the present invention has been described hereinabove with respect to a mold 10 embedded in a particulate mass 20 in an open ended container 30, the invention is not so limited and may be practiced to countergravity cast a melt into a thin shell mold embedded in a particulate mass (e.g., dry foundry sand) in a container having bottom end closed with the exception of a fill pipe (mold ingate passage) extending sealingly therethrough as described in U.S. Pat. No. 5,069,271.

Furthermore, although the present invention described hereinabove with respect to a mold 10 disposed in a particulate mass 20 in a container 30 and cast by countergravity techniques. The invention is not so limited and can be practiced to gravity cast or vacuum-assist gravity cast a melt into a shell mold disposed in a particulate mass (e.g., loose foundry sand like that described hereinabove). The particulate mass is disposed in a container whose bottom is closed by a plate (not shown) for gravity casting or by a vacuum bell or housing (not shown) for vacuum-assisted gravity casting. The shell mold will have riser-forming members similar to those (22) described hereinabove connected thereto so as to be disposed in the particulate mass and to communicate with one or more isolated and/or enlarged regions of the mold cavity requiring additional melt during solidification to accommodate melt shrinkage.

While the invention has been described in terms of specific embodiments thereof, it is not intended to be limited thereto but rather only to the extent set forth hereafter in the following claims.

The embodiments of the invention in which an exclusive property or privilege is claimed are defined as follows:

1. A method of casting a melt, comprising:

a) providing a mold having a mold cavity and an ingate passage communicated to the mold cavity for supplying the melt thereto, said mold having a preformed riser-forming member connected thereto so as to communicate to a region of the mold cavity needing additional melt supply during solidification in the mold to accommodate melt shrinkage thereat, b) disposing a particulate mass about said mold and said riser-forming member, and c) supplying the melt through the ingate passage to the mold cavity and the riser-forming member to fill the mold cavity with the melt and form a riser of melt disposed in said particulate mass and communicated to said region so as to supply additional melt thereto, as necessary, during solidification.

2. The method of claim 1 wherein said riser-forming member comprises a destructible riser-forming member connected to the mold so as to be destroyed and replaced by the melt supplied thereto to form said riser of melt in said particulate mass.

3. The method of claim 2 wherein the destructible riser-forming member comprises an organic material that selectively introduces carbon to the melt forming said riser.

4. The method of claim 1 wherein the riser-forming member is connected to the mold at a passage thereof communicating to said region.

5. The method of claim 4 wherein a protrusion of the riser-forming member is received in the passage.

6. The method of claim 1 wherein the riser-forming member includes a shell comprising an insulating material for providing a relatively higher temperature riser of melt in said mass.

7. The method of claim 1 wherein the melt is countergravity cast to the mold cavity.

8. The method of claim 1 wherein the melt is gravity cast to the mold cavity.

9. The method of claim 1 wherein the riser-forming member includes a shell comprising an exothermic material for providing a relatively higher temperature riser of melt in said mass.

10. A method of countergravity casting a melt, comprising:

a) providing a mold having a mold cavity and an ingate passage communicated to the mold cavity for supplying the melt to the mold cavity, said mold having a preformed riser-forming member connected thereto so as to communicate to a region of the mold cavity needing additional melt supply during solidification in the mold to accommodate melt shrinkage thereat, b) disposing a particulate mass about said mold and said riser-forming member, c) communicating the mold ingate passage and an underlying source of the melt, d) establishing a differential pressure between the mold cavity and the source to draw the melt upwardly through the ingate passage to the mold cavity and the riser-forming member to fill the mold cavity with the melt and form a riser of melt disposed in said particulate mass, and e) solidifying the melt in the mold cavity with the riser of melt communicated thereto so as to supply additional melt to said region, as necessary, during solidification.

11. The method of claim 10 wherein said riser-forming member comprises a destructible riser-forming member preformed apart from the mold and connected to the mold so as to be destroyed and replaced by the melt supplied thereto to form said riser of melt in said particulate mass.

12. The method of claim 11 wherein the destructible riser-forming member comprises an organic material that selectively introduces carbon to the melt forming said riser.

13. The method of claim 10 wherein the riser-forming member is connected to the mold at a passage thereof communicating to said region.

14. The method of claim 13 wherein a protrusion of the riser-forming member is received in the passage.

15. Apparatus for casting a melt, comprising:

a) a mold having a mold cavity and an ingate passage communicated to the mold cavity for supplying the melt thereto, b) a preformed riser-forming member connected to the mold so as to communicate to a region of the mold cavity needing additional melt supply during solidification in the mold to accommodate melt shrinkage, c) a particulate mass disposed about said mold and said riser-forming member, and d) means for supplying the melt through the ingate passage to said mold cavity and said riser-forming member to fill the mold cavity with said melt and to form a riser of said melt disposed in said particulate mass communicated to said region so as to supply additional melt thereto, as necessary, during solidification of said melt.

16. The apparatus of claim 15 wherein the riser-forming member comprises a destructible material that is destroyed and replaced by the melt in said particulate mass.

17. The apparatus of claim 16 wherein the destructible riser-forming member comprises an organic material that selectively introduces carbon to the melt forming said riser.

18. The apparatus of claim 15 wherein the riser-forming member includes a shell comprising an insulating material for providing a relatively higher temperature riser of the melt in said mass.

19. The apparatus of claim 14 wherein said mold is a gravity casting mold.

20. The apparatus of claim 14 wherein said mold is a gas permeable countergravity casting mold.

21. The apparatus of claim 14 wherein the riser-forming member includes s hell comprising an exothermic material for providing a relatively higher temperature riser of melt in said mass.

22. Apparatus for countergravity casting a melt, comprising:

a) a mold having a mold cavity and an ingate passage communicated to the mold cavity for supplying the melt to the mold cavity, b) a preformed riser-forming member connected to the mold so as to communicate to a region of the mold cavity needing additional melt supply during solidification in the mold to accommodate melt shrinkage thereat, c) a particulate mass disposed about said mold and said riser-forming member, d) means for communicating the mold ingate passage an dan underlying source of the melt, and e) means for establishing a differential pressure between the mold cavity and the source to draw the melt upwardly through the ingate passage to the mold cavity and the riser-forming member to fill the mold cavity with the melt for solidification and to form a riser of melt disposed in said particulate mass communicated to said region so as to supply additional melt to said region, as necessary, during solidification.

23. The apparatus of claim 22 wherein the riser-forming member comprises a destructible material that is destroyed and replaced by the melt drawn into the mold.

24. The apparatus of claim 23 wherein the destructible riser-forming member comprises an organic material that selectively introduces carbon to the melt forming riser.

25. The apparatus of claim 22 wherein the riser-forming member is connected to the mold at a passage thereof communicating to said region.

26. The apparatus of claim 25 wherein the riser-forming member includes a protrusion received in the passage.

27. A self-supporting, refractory mold for countergravity casting a melt, comprising a mold cavity and an ingate passage communicated to the mold cavity for supplying melt thereto, and a preformed, riser-forming member connected to the mold as an external appendage thereon communicating to a region of the mold cavity needing additional supply of melt during solidification in the mold to accommodate melt shrinkage.

28. The mold of claim 27 wherein the riser-forming member comprises a material that is destroyed and replaced by the melt.

29. The mold of claim 28 wherein the material selectively introduces carbon to the melt when the riser-forming member is destroyed.

30. The mold of claim 27 wherein said riser-forming member comprises exothermic material.

31. The mold of claim 27 wherein said riser-forming member comprises insulating material.

32. The mold of claim 27 wherein said mold further includes a passage at said region for receiving a portion of said riser-forming member such that said riser-forming member is communicated to said region.

* * * * *

UNITED STATES PATENT AND TRADEMARK OFFICE

CERTIFICATE OF CORRECTION

PATENT NO. : 5 271 451

DATED : December 21, 1993

INVENTOR(S) : George D. CHANDLEY, et al

It is certified that error appears in the above-identified patent and that said Letters Patent is hereby corrected as shown below:

Column 11, line 38; replace "Claim 14" with ---Claim 15---.
line 40; replace "Claim 14" with ---Claim 15---.
line 42; replace "Claim 14" with ---Claim 15---.
line 43; replace "s hell" with ---shell---.
Column 12, line replace "an dan" with ---and an---.

Signed and Sealed this

Thirty-first Day of May, 1994

*Attest:*

*Attesting Officer*

BRUCE LEHMAN

*Commissioner of Patents and Trademarks*